US011692430B2

(12) United States Patent
Volkov et al.

(10) Patent No.: US 11,692,430 B2
(45) Date of Patent: Jul. 4, 2023

(54) METHOD OF CASING INTEGRITY ASSESSMENT IN AN INTERVAL WHERE A CEMENT PLUG IS TO BE INSTALLED IN A WELL PROPOSED FOR ABANDONMENT

(71) Applicant: TGT OILFIELD SERVICES LIMITED, British Virgin Islands (VG)

(72) Inventors: Maksim Vyacheslavovich Volkov, Kazan (RU); Mohammad Abshenas, Aberdin (GB)

(73) Assignee: TGT OILFIELD SERVICES LIMITED, Tortola (VG)

( * ) Notice: Subject to any disclaimer, the term of this patent is extended or adjusted under 35 U.S.C. 154(b) by 114 days.

(21) Appl. No.: 17/283,893

(22) PCT Filed: Oct. 11, 2018

(86) PCT No.: PCT/RU2018/000673
§ 371 (c)(1),
(2) Date: Apr. 8, 2021

(87) PCT Pub. No.: WO2020/076180
PCT Pub. Date: Apr. 16, 2020

(65) Prior Publication Data

US 2021/0355808 A1 Nov. 18, 2021

(51) Int. Cl.
*E21B 47/005* (2012.01)
*E21B 47/107* (2012.01)
(Continued)

(52) U.S. Cl.
CPC ..... *E21B 47/005* (2020.05); *E21B 33/13* (2013.01); *E21B 47/10* (2013.01); *E21B 47/107* (2020.05); *E21B 47/113* (2020.05); *E21B 47/117* (2020.05)

(58) Field of Classification Search
CPC ..... E21B 47/005; E21B 33/13; E21B 47/10; E21B 47/107; E21B 47/113; E21B 47/117
See application file for complete search history.

(56) References Cited

U.S. PATENT DOCUMENTS 6,850,462 B2 2/2005 McDaniel et al.
2015/0204184 A1 7/2015 Davydov et al.

FOREIGN PATENT DOCUMENTS

EP 2 877 693 6/2015
RU 2 092 673 10/1997
(Continued)

OTHER PUBLICATIONS

Image Work Communications. (Feb. 21, 2017). SoCalGas—Well Testing Procedure [Video]. YouTube. https://www.youtube.com/watch?v=pta2bHL4Jyl&t=140s (Year: 2017).*
(Continued)

*Primary Examiner* — Robert E Fuller
(74) *Attorney, Agent, or Firm* — Nixon & Vanderhye PC

(57) ABSTRACT

This invention relates to the method of assessing the integrity of primary and secondary barriers in the interval where a cement plug is to be installed in the well proposed for abandonment. The technical result of the invention is to enhance the accuracy of wellbore barrier integrity assessment. The method of well integrity assessment below production packer, including inner and outer casings, tubing string and production packer installed inside the casing, and cement sheath and adjacent rocks, comprising the following phases: Identification of the target zone for cement plug installation; installation of a temporary cement plug below the target zone; pressure testing and assessment of tubing and below-packer zone integrity based on steady pressure data or pressure variation in time; creation of a perforation zone in casing and cement below production packer in the target zone; conducting a logging survey including noise,
(Continued)

temperature, defectoscopy, and production logging in the target zone during a repeat pressure test; issuance of a findings report on casing and cement integrity and subsequent installation of a cement plug for well abandonment, including rigless operations or remedial cementing at designated locations where integrity failures have been identified on the basis of logging data.

9 Claims, 5 Drawing Sheets

(51) Int. Cl.

| | |
|---|---|
| ***E21B 47/117*** | (2012.01) |
| ***E21B 33/13*** | (2006.01) |
| ***E21B 47/10*** | (2012.01) |
| ***E21B 47/113*** | (2012.01) |

(56) References Cited

FOREIGN PATENT DOCUMENTS

| | | |
|---|---|---|
| RU | 2 534 309 | 11/2014 |
| RU | 2 576 422 | 3/2016 |
| WO | 2013/162411 | 10/2013 |
| WO | 2014/099066 | 6/2014 |
| WO | 2016/108914 | 7/2016 |

OTHER PUBLICATIONS

A. Galiev, et al., "Out of Zone Injection", Society of Petroleum Engineers, SPE-191338-MS, prepared Apr. 18, 2018, 11 pages.
International Search Report for PCT/RU2018/000673 dated Mar. 7, 2019, 3 pages.
Written Opinion of the ISA for PCT/RU2018/000673 dated Mar. 7, 2019, 6 pages.

* cited by examiner

METHOD OF CASING INTEGRITY ASSESSMENT IN AN INTERVAL WHERE A CEMENT PLUG IS TO BE INSTALLED IN A WELL PROPOSED FOR ABANDONMENT

This application is the U.S. national phase of International Application No. PCT/RU2018/000673 filed Oct. 11, 2018 which designated the U.S., the entire contents of which are hereby incorporated by reference.

TECHNICAL FIELD

This invention relates to the method of assessing the integrity of primary and secondary barriers in the interval where a cement plug is to be installed in a well proposed for abandonment.

BACKGROUND ART

There is a known method of well integrity assessment based on acoustic logging as disclosed in EP 2877693 A1, published 3 Jun. 2015.

Drawbacks of the disclosed method are the narrow range of scanned frequencies (up to 11 KHz), short dynamic range, and difficulties in data interpretation. All these factors preclude prompt location of leaks, flow type identification, and flow tracking. According to the results described in earlier published SPE-191338-MS, reservoir acoustic signals, both matrix- and fracture-generated, can occur in a frequency band considerably higher than 11 KHz.

There is another method of well integrity assessment based on spectral noise logging known from background art, as disclosed in WO 2013/162411 A1 and published 31 Oct. 2013.

A drawback of this method is the absence of a testing procedure for a specific wellbore section.

There is still another method of cement integrity assessment based on acoustic cement bond logging that was disclosed in U.S. Pat. No. 6,850,462 B2, published 1 Feb. 2005 (prototype). A drawback of this method is the impossibility to assess the bond between cement and casing or cement and rock in well completions comprising two or more casings, or a tubing string and a casing. The CBL data recorded in the interval of one casing string cannot guarantee that there are no microgaps or channels in the cement. CBL data are interpreted qualitatively.

DISCLOSURE OF INVENTION

The object of the claimed invention is to develop a method to confirm or disprove the effectiveness of primary and secondary barrier isolation in the interval where a cement plug is to be installed in a well proposed for abandonment, with the tubing and casing strings either pulled out or left in the wellbore, using passive acoustic and temperature scanning. The result is to confirm/disprove whether the major NORSOKD-010 requirements are met in the intervals where a cement plug is planned to be installed.

The technical result of the invention is to improve the accuracy of wellbore barrier integrity assessment in the well.

This technical result is achieved through the application of well integrity diagnostics method in the interval below production packer, including inner and outer casings, tubing string and production packer installed inside the casing, and cement sheath and adjacent rocks, comprising the following phases:

a. Identification of the target zone for cement plug installation;

b. Installation of a temporary cement plug below the target zone;

c. Pressure testing and assessment of tubing and below-packer zone integrity based on steady pressure data or pressure variation in time;

d. Creation of a perforation zone in casing and cement sheath in the target zone below production packer;

e. Conducting a logging survey including acoustic, temperature, defectoscopy and production logging during a repeat pressure test in the target zone.

f. Issuance of a findings report on casing and cement integrity and subsequent installation of a cement plug for well abandonment, including rigless operations or remedial cementing at designated locations where integrity failures have been identified on the basis of logging data.

The method of well integrity assessment above production packer, including inner and outer casings, tubing string and production packer installed inside the casing, and cement sheath and adjacent rocks, comprising the following phases:

a. Identification of the target zone for cement plug installation;

b. Installation of a temporary cement plug below the target zone;

c. Pressure testing and assessment of tubing and below-packer zone integrity based on steady pressure data and pressure variation in time;

d. Creation of a perforation zone simultaneously in tubing, casing and cement sheath in the target zone above production packer;

e. Conducting a logging survey including acoustic, temperature, defectoscopy and production logging in the target zone during a repeat pressure test;

f. Issuance of a findings report on casing and cement integrity and subsequent installation of a cement plug for well abandonment, including rigless operations or remedial cementing at designated locations where integrity failures have been identified on the basis of logging data.

A method of integrity assessment in a designated wellbore interval, including inner and outer casings, tubing string and production packer installed inside the casing, and cement sheath and adjacent rocks, comprising the following phases:

a. Identification of the target zone for cement plug installation;

b. Pressure testing and assessment of tubing and below-packer zone integrity based on steady pressure data or pressure variation in time;

c. Creation of a perforation zone in casing and cement at least in two intervals of the target zone and installation between the two perforation zones of an isolation device to separate the two perforation zones by an inflatable packer with additional tubing joints packed off on the end, with the perforation zones being located below the production packer;

d. Conducting a logging survey including acoustic, temperature, defectoscopy and production logging in the target zone during a repeat pressure test;

e. Issuance of a findings report on casing and cement integrity and subsequent installation of a cement plug for well abandonment, including rigless operations or remedial cementing at designated locations where integrity failures have been identified on the basis of logging data.

A method of integrity assessment in a designated wellbore interval, including inner and outer casings, tubing string and production packer installed inside the casing, and cement sheath and adjacent rocks, comprising the following phases:

a. Identification of the target zone for cement plug installation;

b. Pressure testing and assessment of tubing and below-packer zone integrity based on steady pressure data or pressure variation in time;

c. Creation of a perforation zone simultaneously in tubing, casing and cement sheath at least in two intervals of the target zone and installation between the two perforation zones of an isolation device to separate the two adjacent perforation zones by an inflatable packer with additional tubing joints packed off on the end, with one perforation zone being located below the production packer and the other one above the production packer;

d. Conducting a logging survey including acoustic, temperature, defectoscopy and production logging in the target zone during a repeat pressure test;

e. Issuance of a findings report on casing and cement integrity and subsequent installation of a cement plug for well abandonment, including rigless operations or remedial cementing at designated locations where integrity failures have been identified on the basis of logging data.

A method of well integrity assessment in the interval below production packer, including inner and outer casings, cement sheath and adjacent rocks, comprising the following phases:

a. Identification of the target zone for cement plug installation;

b. Installation of a temporary cement plug below the target zone;

c. Pressure testing and integrity assessment of the wellbore based on steady injection pressure data or injection pressure decrease.

d. Creation of a perforation zone in casing and cement sheath above the target zone;

e. Conducting a logging survey including noise, temperature, defectoscopy and production logging in the target zone during a repeat pressure test;

f. Issuance of a findings report on casing and cement integrity and subsequent installation of a cement plug for well abandonment, including rigless operations or remedial cementing at designated locations where integrity failures have been identified on the basis of logging data.

Flow path in the wellbore and behind casing and cement is determined in the locations where integrity failures have been identified on the basis of logging data.

Flows inside the casing and through cement associated with leaks in downhole completions, and flows through fractures and porous reservoirs are determined in the locations where integrity failures have been identified on the basis of logging data.

Fluid loss or fluid inflow zones are determined in the locations where integrity failures have been identified on the basis of logging data.

Casing is perforated and packer is installed inside the casing as many times as necessary in the same well.

BRIEF DESCRIPTION OF DRAWINGS

This invention will be more fully understood from the description which is non-limiting and is provided with references to the accompanying drawings depicting the following.

Figure 1:
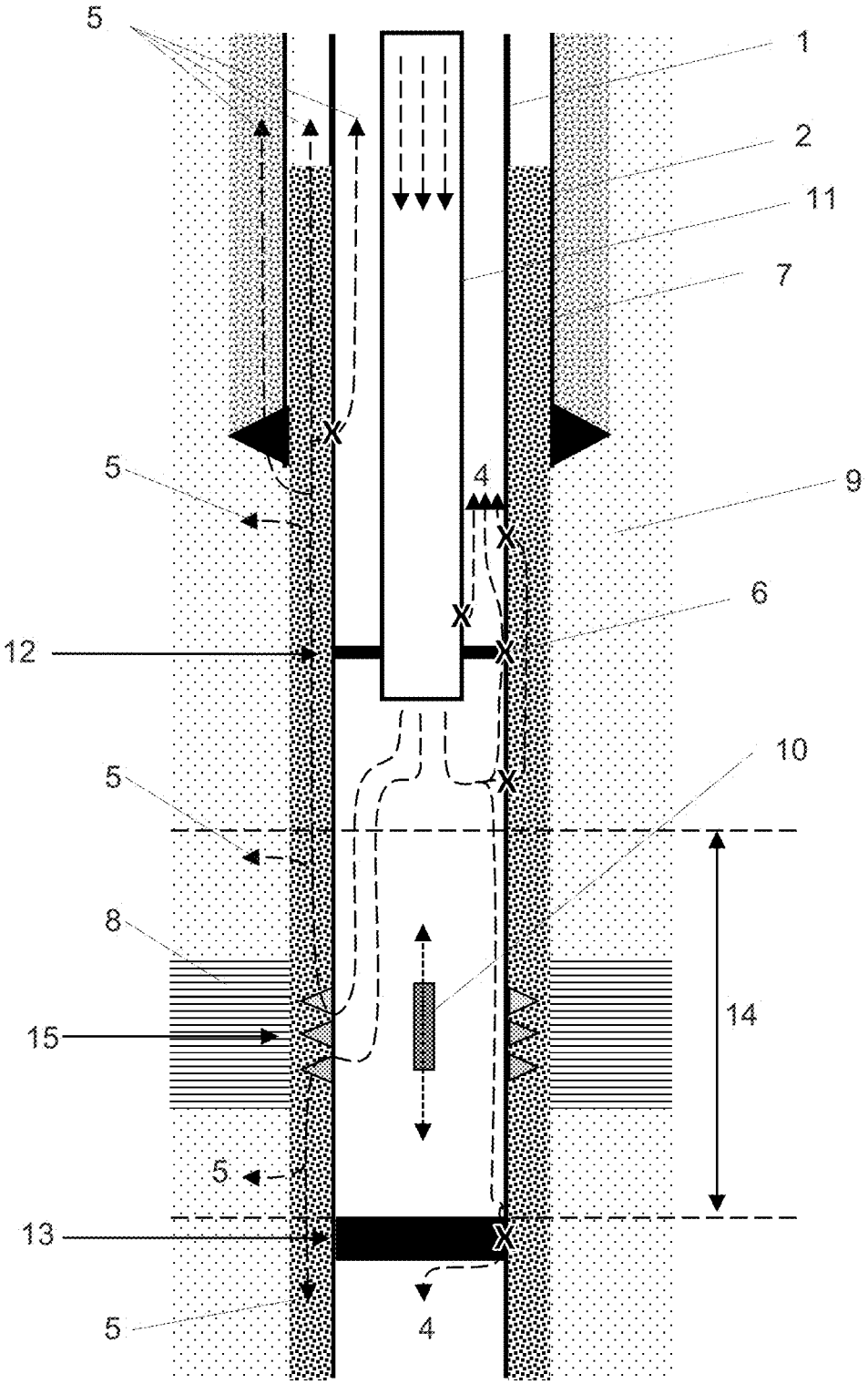
FIG. 1—Well profile: Integrity assessment of the target zone with cement plug installed below production packer and single-shot casing perforation.
Figure 2:
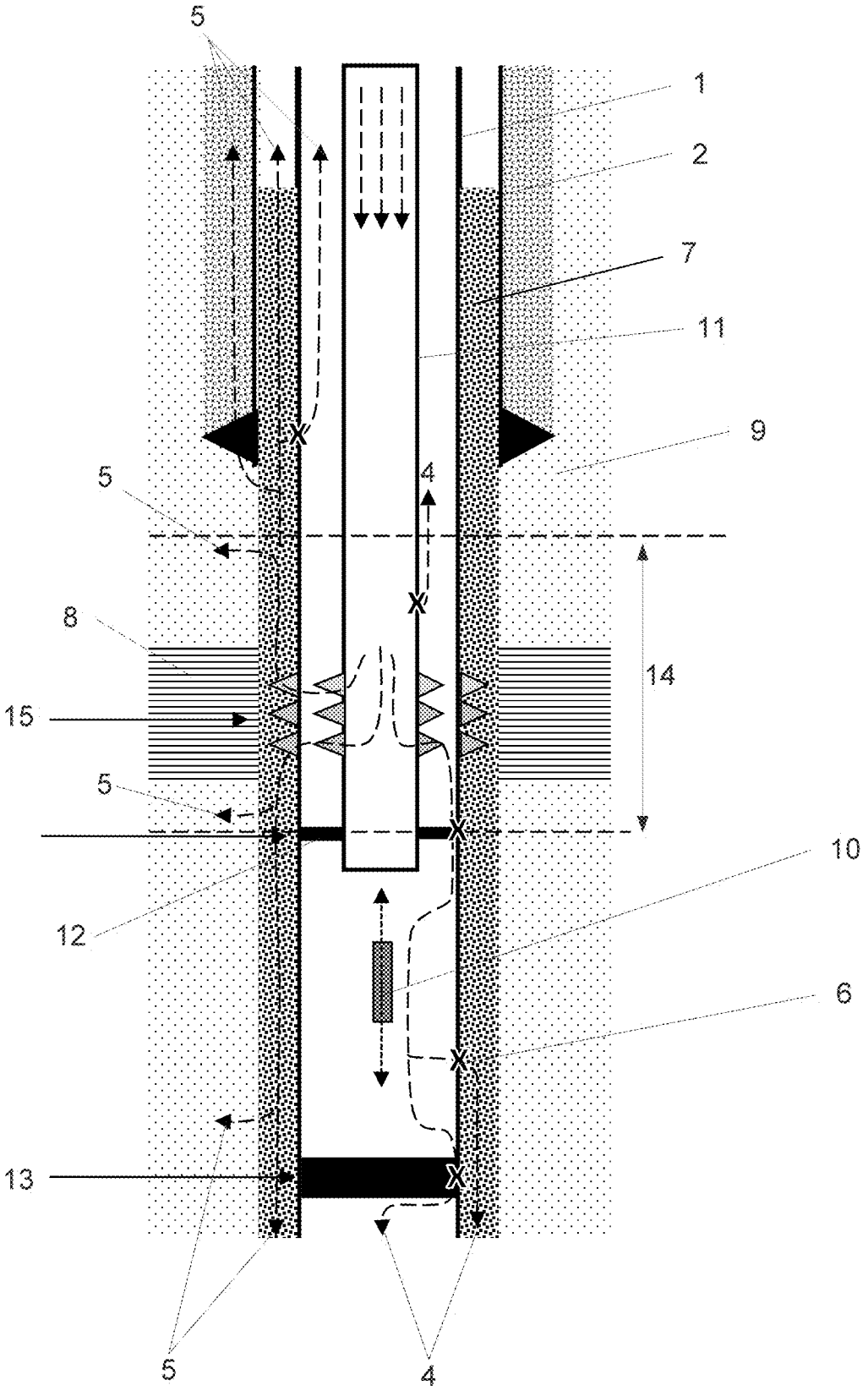
FIG. 2—Well profile: Integrity assessment of the target zone with cement plug installed above production packer and single-shot casing perforation.
Figure 3:
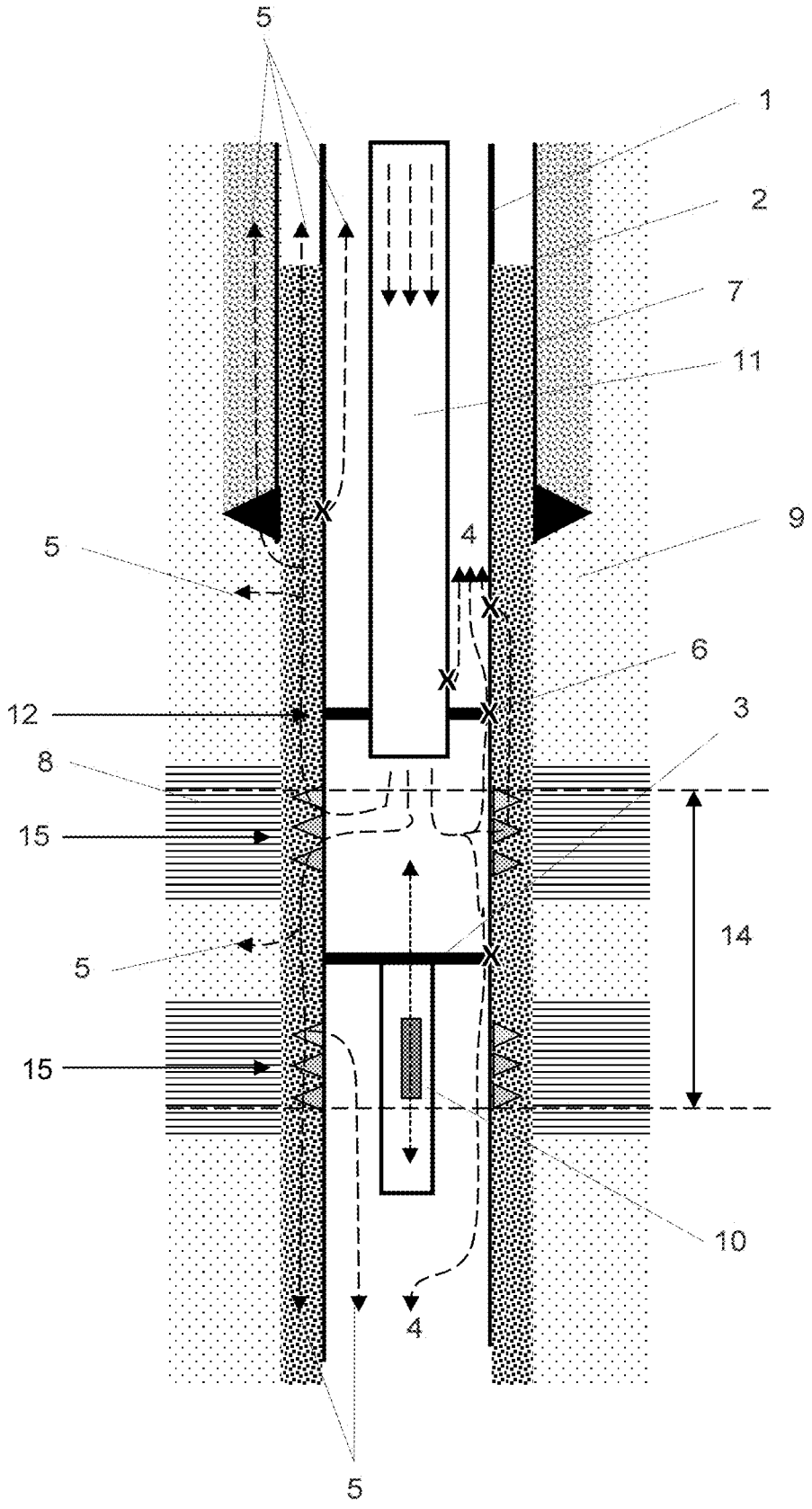
FIG. 3—Well profile: Integrity assessment of the target zone with cement plug installed below production packer and multiple-shot casing perforation.
Figure 4:
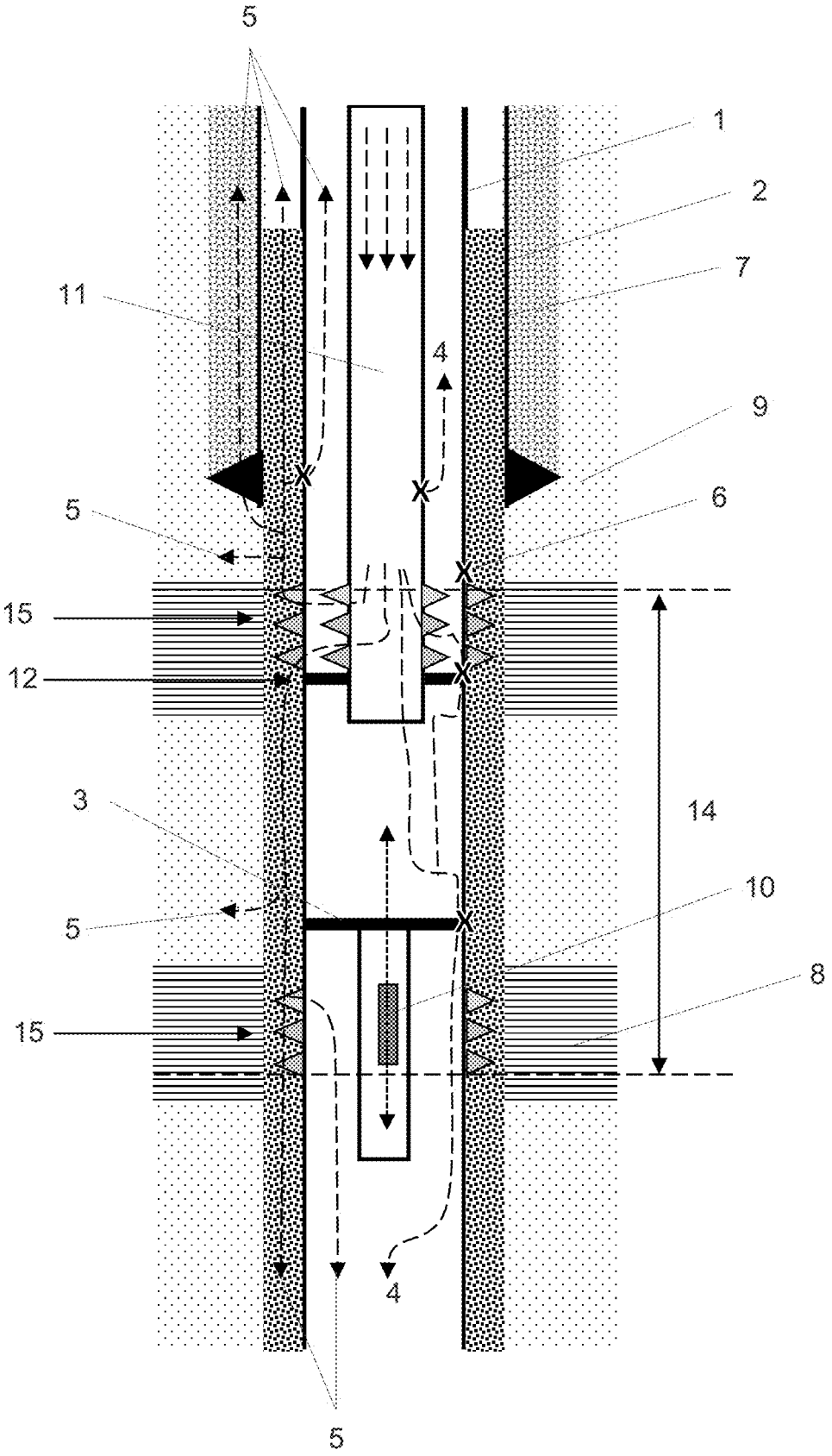
FIG. 4—Well profile: Integrity assessment of the target zone with cement plug installed above production packer and multiple-shot casing perforation.
Figure 5:
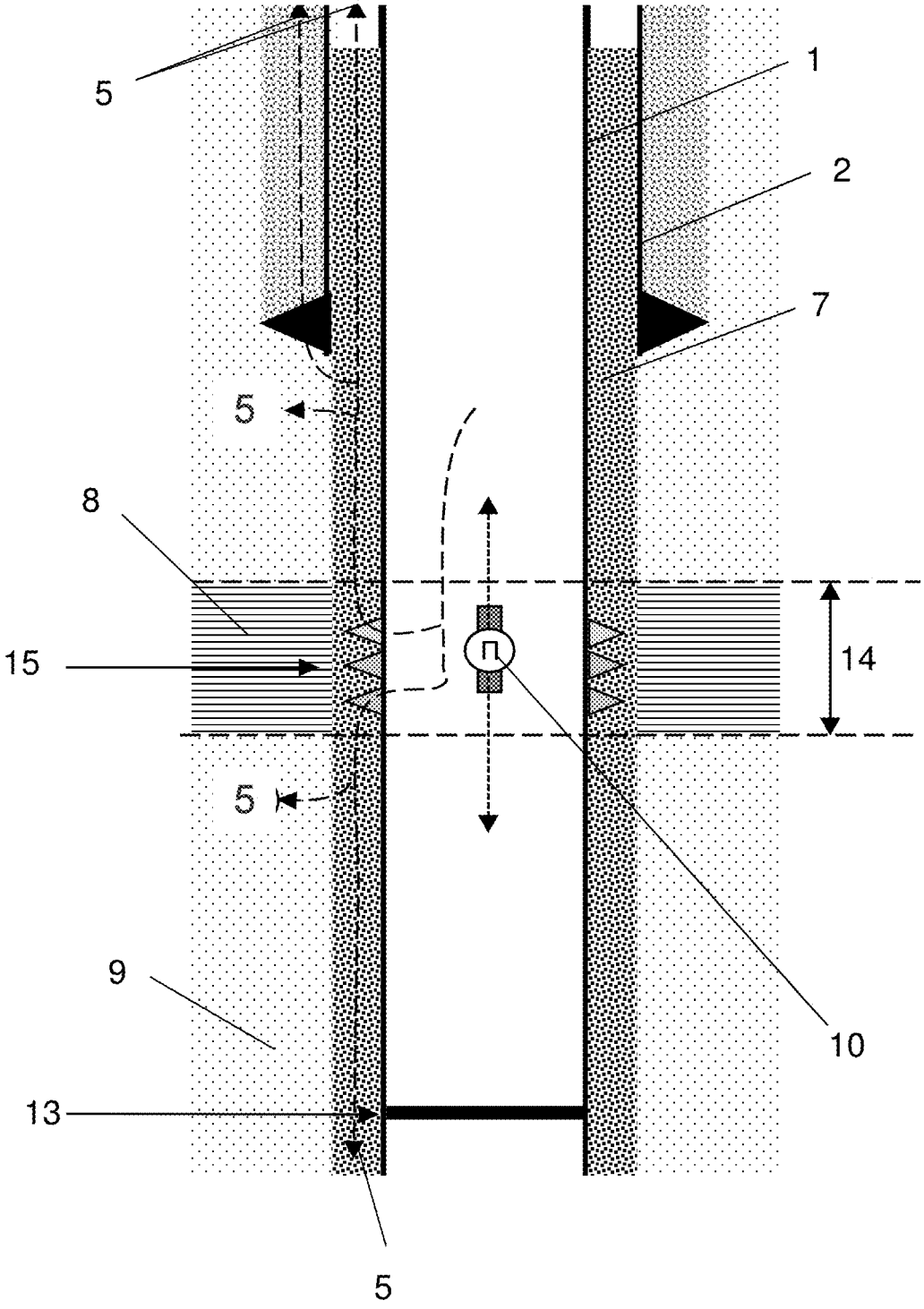
FIG. 5—Well profile: Integrity assessment of the target zone with cement plug installed below the perforation zone (no tubing string and production packer in the wellbore).

1—Casing; 2—Outer casing; 3—Inflatable packer; 4—Flow occurring outside of the target zone; 5—Flow occurring in case of a leak in the target zone; 6—Leaks in completion components; 7—Cement sheath; 8—Low-permeability or impermeable rocks; 9—Permeable rocks; 10—Downhole tool; 11—Tubing; 12—Production packer; 13—Temporary cement plug; 14—Target zone; 15—Perforation zone.

EMBODIMENT OF THE INVENTION

The subject invention exists in five embodiments.

According to one embodiment of the method of integrity assessment in a designated well interval, including inner casing (1) ($1^{st}$ barrier) and outer casing (2) ($2^{nd}$ barrier), tubing (11) and production packer (12) installed inside casing (1), with packer (12) being connected with tubing (11) and casing (1), cement sheath (7) in the annulus formed by inner casing (1) and outer casing (2) and low-permeability or impermeable rocks (8) adjacent to outer casing (2), permeable rocks (9); primarily the target zone (14) where a cement plug is to be installed is determined on the basis of a well lithology analysis. An interval of low-permeability rocks such as shale (8) is selected as the target zone (14), taking into account the Cement Bond Log (CBL) data acquired earlier. If CBL is available, the CBL data interpretation should demonstrate a good cement bond both with casing and rock in the target zone (14). The target zone (14) should be at least 50 m long in accordance with the well abandonment requirements (RF-RD 08-492-02, Norway—NORSOKD-010).

Then a temporary cement plug (13) is installed below the target zone (14). A temporary cement plug (13) in installed in order to isolate reservoirs communicating with the wellbore, reduce the possibility of cross-flows between perforation zones and earlier exposed reservoirs, and increase pressure applied during pressure test and injection in the perforation zone (15).

Then the wellbore is pressure tested, wherefore injection pressure or negative pressure is created and tubing (11) and below-packer zone integrity is assessed on the basis of steady pressure data or pressure variation. Pressure variations are created through injection or reduction of hydrostatic pressure by displacing the lower-density fluid inside tubing (11) into internal casing (1) and circulation in the annulus. The injection pressure should be equal to ¾ of the maximum allowable annulus pressure and exceed the pressure in the currently developed or potential reservoirs. A pressure transient test is conducted for 30 min and if the pressure during this time has not changed by more than 5%, it can be tentatively concluded that tubing (11) and sub-packer zone of casing (1) hold tight. If the pressure during this time has changed by more than 5%, it can be tentatively concluded that there is a leak in the casing (1).

Afterwards a perforation zone (15) is created in casing (1) and cement sheath (7) below production packer (12) in target zone (14). One perforation zone (15) is used in those cases when permeable formations, top of cement or potential fluid loss zones are situated in the vicinity of target zone (14).

Then, if the pressure test proves the completion integrity, a logging survey is conducted during a repeat pressure test, to record acoustic, temperature, defectoscopy and production logging data in target zone (14), wherefore downhole tool (10) is run into the well to the perforation zone where acoustic, temperature, electromagnetic defectoscopy and production logging data are recorded. If no cross-flows and completion leaks have been identified according to logging data, the target zone integrity is considered to have been proved and the verification process is repeated in the next cement plug installation interval or in the next well. If all target zones have been successfully verified, the well is subject to rigless plug and abandonment.

If during the wellbore pressure test the pressure changes by more than 5%, a logging survey is conducted to record acoustic, temperature, defectoscopy and production data in target zone (14), wherefore downhole tool (10) is run into the well to perforation zone (15) where acoustic, temperature, electromagnetic defectoscopy and production logging data are recorded. If the logging data have identified fluid channeling in the cement, a decision is made to perform remedial cementing; if the logging data have shown that the fluid is lost directly into the formation within the perforation zone, the target zone is considered to be suitable for cement plug installation and the well is proposed as a candidate for rigless plug and abandonment.

Based on electromagnetic defectoscopy, acoustic, temperature, and production logging data, the well is surveyed in two regimes—in static conditions, before and after pressure testing. With the well being in static condition, temperature gradient and the level of natural noise in the well are measured, which, when the data are interpreted, helps to identify zones of circulation and cross-flows, both in the wellbore and the annulus. During injection, temperature, acoustic, and production logging measurements identify the anomalies that are typical to leaks, behind-casing flows, and active reservoir zones where injection fluid is lost. The presence of corrosion and other defects of tubing (11), casing (1), and outer casing (2) is verified according to electromagnetic defectoscopy data. Fluid flows in the wellbore and behind casing (production logging data) are also recorded during injection.

This well survey method is applicable to all proposed embodiments.

The method of well integrity diagnostics in a designated well interval according to the second embodiment is similar to that of the first embodiment, with the only difference being that perforation zone (15) in casing (1), cement sheath (7) and, additionally, in tubing (11) is created above production packer (12) in target zone (14).

According to the third embodiment of the method of integrity assessment in a designated well interval, including inner casing (1) (1st barrier) and outer casing (2) (2nd barrier), tubing (11) and production packer (12) installed inside casing (1), with inflatable packer (3) being connected to a pipe placed inside the casing below production packer (12), cement sheath (7) in the annulus formed by inner casing (1) and outer casing (2), and low-permeability or impermeable rocks (8) and permeable rocks (9), adjacent to casing (1); primarily the target zone (14) where a cement plug is to be installed is determined on the basis of well lithology analysis. An interval of low-permeability rocks such as shale (8) is selected as the target zone (14), taking into account the Cement Bond Log (CBL) data acquired earlier. If CBL is available, the CBL data interpretation should demonstrate a good cement bond both with casing and rock in target zone (14). Target zone (14) should be at least 50 m long in accordance with the well abandonment requirements (RF-RD 08-492-02, Norway—NORSOKD-010).

Then the wellbore is pressure tested, wherefore injection pressure or negative pressure is created and the integrity of tubing (11) and two below-packer zones are assessed on the basis of steady pressure data or pressure variation, in a manner similar to the first embodiment of the invention. Pressure test is conducted for 30 minutes and if by that time the pressure has changed for less than 5%, casing (1) is tentatively considered to be leak-tight. If by that time the pressure has changed for more than 5%, casing (1) is tentatively considered to be leaking.

Afterwards two perforation zones (15) are created in casing (1) and cement sheath (7), in two intervals below production packer in target zone (14). Afterwards, an isolation device in the form of an inflatable packer (3) with additional tubing joints packed off on the end are installed between two perforation zones (15), which is run into the well with several connected tubing joints, and then inflatable packer (3) is installed inside casing (1) between adjacent perforation zones (15) in such a manner that the additional tubing joints overlap the lower perforation zone (15). Using two or more perforation zones (15) is appropriate in those cases when CBL data are unavailable and impermeable formation zones are of limited extent.

Then, if during a wellbore pressure test the pressure does not change, a logging survey is conducted during a repeat pressure test to record acoustic, temperature, defectoscopy, and production logging data in target zone (14), wherefore downhole tool (10) is run into the well to perforation zones (15) where electromagnetic defectoscopy, temperature, acoustic, and production data are recorded. If no cross-flows and wellbore leaks have been identified according to logging data, target zone (14) integrity is considered to have been proved and the verification process is repeated in the next target zone or in the next well. If all target zones have been successfully verified, the well is subject to rigless plug and abandonment.

If during a wellbore pressure test the pressure has changed, a logging survey is conducted to record acoustic, temperature, and defectoscopy data in target zone (14), wherefore downhole tool (10) is run into the well to perforation zones (15) where electromagnetic defectoscopy, temperature, acoustic, and production logging data are recorded. If the logging data have identified channeling in the cement, a decision is made to perform remedial cementing.

If the well has three or more perforation zones (15), when the pressure test and logging survey are over, inflatable packer (3) and additional tubing joints are successively shifted to the interval between the adjacent perforation zones (15), after which the pressure test and logging survey are repeated.

The method of well integrity diagnostics in a specific well interval according to the fourth embodiment is similar to that of the third embodiment, with the only difference being that two perforation zones (15) in casing (1), cement sheath (7) and, additionally, in tubing (11) are created in such a manner that one perforation zone (15) is located above production packer (12) in target zone (14), and the other one below.

According to the fifth embodiment (with no tubing and production packer in the surveyed well) of the method of integrity assessment in a designated well interval, including inner casing (1) (1st barrier) and outer casing (2) (2nd barrier), cement sheath (7) situated inside the annulus formed by inner casing (1) and outer casing (2), and low-permeability or impermeable rocks (8) adjacent to outer casing (2), and permeable rocks (9), primarily target zone (14) where a cement plug is to be installed is determined on the basis of well lithology analysis. An interval of low-permeability rocks such as shale (8) is selected as the target zone (14), taking into account the Cement Bond Log (CBL) data acquired earlier. If CBL is available, the CBL data interpretation should demonstrate a good cement bond both with casing and rock in target zone (14). Target zone (14) should be at least 50 m long in accordance with the well abandonment requirements (RF-RD 08-492-02, Norway—NORSOKD-010).

Then a temporary cement plug (13) is installed below target zone (14). Temporary cement plug (13) is installed in order to isolate reservoirs communicating with the wellbore, reduce the possibility of cross-flows between perforation zones and earlier exposed reservoirs, and increase pressure applied during testing and injection in perforation zone (15).

Afterwards, perforation zone (15) is created in casing (1) and cement sheath (7) above temporary cement plug (13) in target zone (14).

Then the wellbore is pressure tested, wherefore injection pressure or negative pressure is created and wellbore integrity is assessed on the basis of steady pressure data or pressure variation. Pressure is changed through injection of fluid into inner casing (1) or alteration of hydrostatic pressure by displacing the fluid with a lower-density fluid and circulation in the annulus. Pressure test is conducted for 30 minutes and if by that time the pressure has not changed for more than 5%, casing (1) is tentatively considered to be leak-tight. If by that time the pressure has changed for more than 5%, casing (1) is tentatively considered to be leaking.

If after the wellbore pressure test the pressure has not changed, a logging survey is conducted during a repeat pressure test to record acoustic, temperature, electromagnetic defectoscopy, and production logging data in target zone (14), wherefore downhole tool (10) is run into the well to the perforation zone where electromagnetic defectoscopy, temperature, acoustic, and production logging data are recorded. If no cross-flows and completion leaks have been identified according to logging data, the target zone integrity is considered to have been proved and the verification process is repeated in the next cement plug installation interval or in the next well. If all target zones have been successfully verified, the well is subject to rigless plug and abandonment.

If after the wellbore pressure test the pressure has changed, a logging survey is conducted to record acoustic, temperature, and defectoscopy data in target zone (14), wherefore downhole tool (10) is run into the well to perforation zone (15) where electromagnetic defectoscopy, temperature, noise, and production logging data are recorded. If the logging data have identified channeling in the cement, a decision is made to perform remedial cementing.

The invention has been disclosed above with a reference to its specific embodiment. Other embodiments of the invention, which do not depart from the spirit thereof, as it has been disclosed herein, may be apparent to those skilled in the art. Therefore, this invention should be regarded as limited in scope only by the formula of invention described below.

The invention claimed is:

1. A method of well integrity assessment in an interval including a casing, a tubing string and a production packer placed inside the casing, and a cement sheath and rocks adjacent thereto, the method comprising:

identifying a target zone below the production packer for installing a cement plug;

installing a temporary cement plug below the target zone;

pressure testing the target zone;

assessing an integrity of the target zone based on steady pressure data or pressure variation in time;

perforating a zone in the casing and the cement sheath in the target zone below the production packer;

initiating a repeat pressure test of the target zone;

during the repeat pressure test, conducting a logging survey including acoustic, temperature, defectoscopy, and production logging in the target zone;

issuing a findings report on integrity of the casing and the cement sheath for subsequent installation of the cement plug for well abandonment via rigless operations or remedial cementing at designated locations where integrity failures have been identified based on the logging survey.

2. The method according to claim 1, further comprising determining a flow path in the well behind the casing and in the cement sheath in the designated locations where integrity failures have been identified based on the logging survey.

3. The method according to claim 1, further comprising determining wellbore flow, cement channeling due to completion integrity breaches, fracture flow and porous reservoir flow in the designated locations where integrity failures have been identified based on the logging survey.

4. The method according to claim 1, further comprising determining behind-casing fluid loss or fluid inflow zones in the designated locations where integrity failures have been identified based on the logging survey.

5. The method according to claim 1, further comprising perforating the casing and placing the production packer in the casing at another location in the well.

6. A method of well integrity assessment in an interval including a casing, a tubing string and a production packer placed inside the casing, and a cement sheath and rocks adjacent thereto, the method comprising:

identifying a target zone above the production packer for cement plug installation;

installing a temporary cement plug below the target zone;

pressure testing the target zone;

assessing an integrity of the target zone based on steady pressure data or pressure variation in time;

perforating the casing and cement sheath in the target zone above the production packer;

initiating a repeat pressure test of the target zone;

during the repeat pressure test, conducting a logging survey including acoustic, temperature, defectoscopy, and production logging in the target zone;

issuing a findings report on integrity of the casing and the cement sheath for subsequent installation of the cement plug for well abandonment via rigless operations or remedial cementing at designated locations where integrity failures have been identified based on the logging survey.

7. A method of well integrity assessment in an interval including a casing, a tubing string and a production packer placed inside the casing, and a cement sheath and rocks adjacent thereto, the method comprising:

identifying at least two target zones below the production packer for cement plug installation;

pressure testing the at least two target zones;

assessing an integrity of the at least two target zones based on steady pressure data or pressure variation;

perforating the casing and cement sheath in the at least two target zones;

installing an inflatable packer between the at least two target zones;

initiating a repeat pressure test of the at least two target zones;

during the repeat pressure test, conducting a logging survey including acoustic, temperature, defectoscopy, and production logging in the at least two target zones;

issuing a findings report on integrity of the casing and the cement sheath for subsequent installation of the cement plug for well abandonment via rigless operations or remedial cementing at designated locations where integrity failures have been identified based on the logging survey.

8. A method of well integrity assessment in an interval including a casing, a tubing string and a production packer placed inside the casing, and a cement sheath and rocks adjacent thereto, comprising the following phases:

identifying at least two target zones for cement plug installation, wherein one target zone is situated above the production packer and the other is situated below the production packer;

pressure testing the at least two target zones;

assessing an integrity of the at least two target zones based on steady pressure data or pressure variation in time;

perforating the tubing string, the casing, and the cement sheath in the at least in two target zones;

installing an inflatable packer between the at least two target zones;

initiating a repeat pressure test of the target zone;

during the repeat pressure test, conducting a logging survey including acoustic, temperature, and defectoscopy in the at least two target zones;

issuing a findings report on integrity of the casing and the cement sheath for subsequent installation of the cement plug for well abandonment via rigless operations or remedial cementing at designated locations where integrity failures have been identified based on the logging survey.

9. A method of well integrity assessment in an interval including a casing, a cement sheath and rocks adjacent thereto, the method comprising:

identifying a target zone for cement plug installation;

installing a temporary cement plug below the target zone;

pressure testing the target zone;

assessing an integrity of the target zone based on steady or dropping pressure data;

perforating the casing and the cement sheath in the target zone above the temporary cement plug;

initiating a repeat pressure test of the target zone;

during the repeat pressure test, conducting a logging survey including acoustic, temperature, defectoscopy, and production logging in the target zone;

issuing a findings report on integrity of the casing and the cement sheath for subsequent installation of the cement plug for well abandonment via rigless operations or remedial cementing at designated locations where integrity failures have been identified based on the logging survey.

* * * * *